US010759580B2

(12) United States Patent
Davis et al.

(10) Patent No.: US 10,759,580 B2
(45) Date of Patent: Sep. 1, 2020

(54) CHILD-RESISTANT SAFETY PACKAGE

(71) Applicant: Multi Packaging Solutions UK Limited, Nottingham (GB)

(72) Inventors: Nigel Davis, Nottingham (GB); Marc Scholiers, Dilbeek (BE)

(73) Assignee: Multi Packaging Solutions UK Ltd., Nottingham (GB)

( * ) Notice: Subject to any disclaimer, the term of this patent is extended or adjusted under 35 U.S.C. 154(b) by 0 days.

(21) Appl. No.: 16/134,138

(22) Filed: Sep. 18, 2018

(65) Prior Publication Data

US 2019/0084740 A1 Mar. 21, 2019

(30) Foreign Application Priority Data

Sep. 19, 2017 (GB) ..... 1715126.7

(51) Int. Cl.

| | |
|---|---|
| ***B65D 75/36*** | (2006.01) |
| ***B65D 5/38*** | (2006.01) |
| ***B65D 83/04*** | (2006.01) |
| ***A61J 1/03*** | (2006.01) |

(52) U.S. Cl.

CPC ..... *B65D 75/367* (2013.01); *A61J 1/035* (2013.01); *B65D 5/38* (2013.01); *B65D 83/0463* (2013.01); *B65D 2203/00* (2013.01); *B65D 2203/12* (2013.01); *B65D 2215/04* (2013.01); *B65D 2575/362* (2013.01)

(58) Field of Classification Search

CPC ..... A61J 1/035; B65D 5/38; B65D 85/0463; B65D 2203/00; B65D 2215/04; B65D 2575/362

USPC ..... 206/531, 1.5, 532, 539; 229/125.125

See application file for complete search history.

(56) References Cited

U.S. PATENT DOCUMENTS

| | | | | |
|---|---|---|---|---|
| 6,047,829 | A * | 4/2000 | Johnstone | B65D 5/38 206/1.5 |
| 6,230,893 | B1 * | 5/2001 | Karow | B65D 5/38 206/1.5 |
| 6,491,211 | B1 * | 12/2002 | Evans | B65D 5/38 206/532 |
| 6,874,636 | B2 * | 4/2005 | Paliotta | B65D 75/327 206/1.5 |
| 7,845,496 | B2 * | 12/2010 | Hession | B65D 5/38 206/528 |

(Continued)

FOREIGN PATENT DOCUMENTS

WO WO2015066109 A1 5/2015

OTHER PUBLICATIONS

EP search report for EP18195295.3 dated Dec. 14, 2018.

*Primary Examiner* — Chun Hoi Cheung
(74) *Attorney, Agent, or Firm* — Getz Balich LLC

(57) ABSTRACT

A package includes an outer sleeve and a slider for holding a blister pack slidably mounted within the outer sleeve. The outer sleeve has a locking edge. The slider has a locking flap extending in a direction away from the closed end of the outer sleeve for engagement with the wall of the outer sleeve. The flap has a free edge which provides a pair of locking edges for engagement with the locking edge of the outer sleeve wall. The outer sleeve has a release button which may be pressed to deflect the slider flap away from the wall of the outer sleeve and enable the free edge of the slider flap to slide past the locking edge to allow the slider to be withdrawn from the outer sleeve.

19 Claims, 12 Drawing Sheets

(56) References Cited

U.S. PATENT DOCUMENTS

| | | | | |
|---|---|---|---|---|
| 8,011,512 | B2 * | 9/2011 | Brollier | A61J 1/035 206/1.5 |
| 8,066,121 | B2 | 11/2011 | Sack et al. | |
| 8,499,936 | B2 * | 8/2013 | Albrecht | B65D 83/0463 206/528 |
| 8,939,281 | B2 * | 1/2015 | Matsuba | B65D 83/0463 206/1.5 |
| 9,931,273 | B2 * | 4/2018 | Hammond | A61J 1/035 |
| 9,994,353 | B2 * | 6/2018 | Patwardhan | B65D 77/0433 |
| 2009/0301924 | A1 | 12/2009 | Rondeau | |
| 2015/0307246 | A1 | 10/2015 | Patwardhan | |
| 2016/0001948 | A1 * | 1/2016 | Collins | B65D 75/327 206/486 |
| 2016/0122106 | A1 | 5/2016 | Hammond et al. | |
| 2017/0267396 | A1 * | 9/2017 | Hammond | B65D 75/367 |

* cited by examiner

CHILD-RESISTANT SAFETY PACKAGE

This application claims priority to Great Britain Patent Appln. No. 1715126.7 filed on Sep. 19, 2017, which is herein incorporated by reference in its entirety.

BACKGROUND OF THE INVENTION

Technical Field

The present invention relates to packaging, more particularly child resistant packaging. The present invention is, in particular, although not exclusively, directed to packaging for pharmaceutical products. The packaging is made of a foldable sheet material, such as cardboard, paperboard, or the like. The present invention seeks to provide an improved child-resistant safety package.

Background Information

The Applicant has realized that there is a need for improved safety packaging that prevents, or at least makes more difficult, the dispensing of the contents of the packaging by children.

Pharmaceutical products are frequently supplied in blister packs. A blister pack comprises one or more "blisters" which hold capsules, tablets or other items and whose face is sealed by a foil or other film. The blister contents are dispensed by the user pressing down on the blister, thereby pushing the contents of the blister out through the sealing film.

Typically, the blister pack is supplied in an external package from which the blister pack must be removed to dispense the blister contents. A problem with blister packs is, however, that the blister's contents may be dispensed quite easily by children. There have therefore been various proposals for making it more difficult for children to dispense contents from a blister pack. To this end, various mechanisms have been proposed to make it more difficult for a child to remove a blister pack from its external package. Typically such mechanisms comprise a locking mechanism which must be released to allow the blister pack to be accessed.

The present invention seeks to provide a further package of this type with child resistance.

SUMMARY OF THE INVENTION

According to the invention there is provided a package as set forth in claim 1.

The free edge of the slider flap which engages with the locking edge(s) of the set of locking edge(s) of the outer sleeve wall to prevent the slider from being withdrawn from the outer sleeve may be referred to herein as the "locking edge" of the slider.

The outer sleeve wall has a set of one or more locking edges which cooperate with the locking edge of the slider. It will be appreciated that the outer sleeve wall may include only this set of locking edges, or may include additional locking edge(s) e.g. to cooperate with the locking edge of the slider, or another component thereof to inhibit full removal of the slider from the sleeve, or for some other purpose. The set of one or more locking edges associated with the outer sleeve wall referred to herein, are those locking edge(s) which cooperate with the locking edge of the slider to prevent withdrawal of the slider by more than the predetermined amount. Any references to the locking edge(s) of the outer sleeve or outer sleeve wall should be understood as referring to these locking edge(s) unless the context demands otherwise. The locking edge(s) of the outer sleeve wall may be referred to as the locking edge(s) of the outer sleeve for brevity herein. The outer sleeve may be referred to as the "sleeve".

The outer sleeve wall having the set of locking edge(s) has end edges at the closed and open ends of the sleeve, the end edges being connected by side edges. The wall of the sleeve having the locking edge(s) may provide a first wall of the sleeve, the sleeve further comprising an opposite second wall, an end wall, and a pair of side walls connecting the first and second walls. The first and second walls may define facing panels of the sleeve.

Withdrawal of the slider from the outer sleeve by more than a predetermined amount is prevented by engagement of opposed locking edges provided on the sleeve wall and the slider. The slider can however be withdrawn further when a release button on the sleeve is pressed to deflect the locking edge of the slider inwardly i.e. into the interior of the outer sleeve, thereby preventing the locking edge of the slider from engaging the locking formation (s) of the outer sleeve wall as the slider is withdrawn further from the sleeve. The release button lifts the locking edge of the slider to enable it to slide over the locking formation (s) of the sleeve wall. This may enable the locking edge of the slider to avoid engaging the locking formation (s) of the sleeve wall. It will be appreciated that the locking edge of the slider may contact the locking formation (s) of the sleeve wall as it passes them, but a locking engagement between them is prevented.

In accordance with the invention, the release button is operable in this manner to enable the slider to be withdrawn from the outer sleeve by more than the predetermined amount corresponding to the position in which the locking edges of the slider and sleeve wall are engaged only when the slider is inserted into the outer sleeve further than the locking position to a position intermediate its locked position and a fully inserted position in which the slider is fully inserted into the outer sleeve. Accordingly, pressing of the release button with the slider in its locked position does not deflect the flap away from the wall of the slider to avoid locking engagement of the free edge of the slider flap and the locking formation(s) of the outer sleeve wall as if a user attempts to withdraw the slider from the outer sleeve when the slider is in its locked position. This provides a greater level of child resistance, as the user must first slide the slider further into the outer sleeve before pressing the release button, in order to prevent operation of the lock, and enable the slider to be withdrawn from the outer sleeve. Thus, a sequence of operations is required in order to withdraw the slider sufficiently to obtain access to the content thereof. The package may therefore be arranged such that the slider must be inserted further into the outer sleeve by a predetermined amount before the release button is operable to deflect the locking edge of the slider inwardly to prevent the locking edge of the slider from engaging the set of one or more locking formation (s) of the outer sleeve wall as the slider is withdrawn from the sleeve.

The extent to which the slider must be further inserted into the outer sleeve to result in the release button at least partially overlapping the flap of the slider to allow it to deflect the flap of the slider may be set as desired. This may be controlled by appropriate selection of factors including the spacing between the release button and the closed end of the sleeve, the length of the slider flap, and its inclination in the assembled package etc. There may be a range of positions of the slider relative to the outer sleeve starting from the fully inserted position of the slider in which the release button is not operable to deflect the flap of the slider to deflect it away from the wall of the outer sleeve before the release button is so operable.

In embodiments the slider may be withdrawn from the sleeve by a predetermined amount before the free edge of the slider flap engages the or each locking edge of the set of one or more locking edges of the outer sleeve, the predetermined amount being insufficient for a user to access the blister pack.

The locking edge of the slider and the set of one or more locking edges of the outer sleeve wall may engage one another along a line of engagement (when the slider is in the locked position relative to the sleeve). Thus, the line of engagement is spaced from the end of the sleeve. The line of engagement is preferably a straight line. The line of engagement is defined by the position of the locking edge(s) of the outer sleeve wall. Where the outer sleeve wall includes multiple locking edges, the line of engagement may be a line connecting the locking edges. Thus, where a set of multiple locking edges are provided on the sleeve wall, the locking edge of the slider is arranged to substantially simultaneously contact each of the locking edges of the set.

The locking edge(s) of the sleeve wall need not extend along the whole length of the line of engagement. The locking edge of the slider i.e. the free edge of the slider flap, may connect the locking edges of the sleeve wall. The line of engagement is preferably parallel to the closed end of the outer sleeve. The or each locking edge of the set of one or more locking edges of the outer sleeve wall is preferably parallel, (i.e. extends parallel) to the closed end of the outer sleeve. This may provide a simpler and more space efficient arrangement. However, it will be appreciated that the orientation of the line of engagement, and hence the locking (s) of the outer sleeve wall may alternatively be at an angle to the closed end of the sleeve. In such arrangements, the free edge of the slider which provides the cooperating locking edge of the slider preferably extends along a line at a corresponding angle to the closed end of the outer sleeve to ensure secure engagement between the locking edges of the sleeve and slider. While the line of engagement will typically be straight, other possibilities may be envisaged, where multiple locking edges of a sleeve wall are not connected by a straight line, or where a single locking edge is provided that is not straight. In such cases the locking edge of the slider would need to be of a corresponding shape. The configuration of the locking edge(s) of the sleeve wall, and their position, is not critical, provided that they may interact with the locking edge of the slider in the manner required. However, for ease of manufacture and assembly, the or each locking edge of the slider and the set of one or more locking edges of the sleeve wall are preferably straight.

Preferably when the locking edges of the slider and the outer sleeve wall engage, pressing of the release button is not effective to disengage the locking edge of the slider from the or each locking edge of the set of one or more locking edges of the outer sleeve wall. Thus, the slider may not be further withdrawn from the outer sleeve. In these preferred embodiments, the release button is operable to deflect the flap so as to permit the free edge of the slider flap to slide past the or each locking edge of the set of one or more locking edges of the outer sleeve wall (to allow the sleeve to be withdrawn by more than the predetermined amount) only when the slider is located in one or more intermediate position relative to the outer sleeve between a position in which the slider is fully inserted in the outer sleeve and a position in which the slider is in a locked position in which the free edge of the locking flap is in engagement with the or each locking edge of the set of one or more locking edges of the outer sleeve wall. These embodiments are advantageous in providing a further level of child resistance. In order to open the package, the user must slide the slider to an intermediate position between the fully closed position, and the locked position in which the locking edges engage, in order for the release button to be operable to permit unlocking of the package. If the user slides the slider too far out of the package, so as to reach the locked position in which the locking edges engage, they must then retract the slider, but not so far as to be fully inserted in the outer sleeve, before the release button is operable to unlock the package.

This functionality may be achieved by selecting the position of the release button relative to a line of engagement of the locking edges of the slider and outer sleeve wall appropriately. Thus, the release button may be located relative to a line of engagement of the locking edges of the slider and outer sleeve wall in a manner to achieve the above mentioned effects. The locking edge of the slider flap may not overlap the release button when the slider is in a position relative to the outer sleeve such that the locking edge of the slider and the set of one or more locking edges of the outer sleeve wall are engaged, or may overlie a base region of the release button, such that the release button is unable to deflect the flap to an extent necessary to disengage the locking edges. It will be appreciated that the extent to which the release button may be deflected inwardly so as to deflect the flap will naturally be less toward a base region of the button. The degree of deflection of the release button may additionally or alternatively be controlled by joining a tab to the base region thereof, or by other suitable means.

The release button may be operable to deflect the flap so as to permit the free edge of the slider flap to slide past the or each locking edge of the set of one or more locking edges of the outer sleeve wall when the slider is located in a range of intermediate positions relative to the outer sleeve between a position in which the slider is fully inserted in the outer sleeve and a position in which the slider is partially withdrawn from the outer sleeve so as to be in the locked position. In preferred embodiments it is only when the locking edges of the slider and the outer sleeve wall are engaged, i.e. when the slider is in the locked position relative to the sleeve, that the release button is ineffective to deflect the flap so as to permit further withdrawal of the slider. The release button may be effective to deflect the flap to permit unlocking of the package over a range of relative positions of the slider and sleeve up until the locking edges are engaged. Of course, the release button is also ineffective to deflect the slider flap when the slider is fully inserted in the sleeve.

In certain embodiments, the slider locking flap may comprise a recess in a distal edge thereof which aligns with a portion of the release button when the slider is fully inserted in the sleeve, the release button being capable of entering the recess in that position, thereby preventing or providing ineffective deflection of the slider flap. Preferably the outer sleeve wall has an outer panel and an inner panel, the set of one or more locking edges of the sleeve wall being formed at a terminal end of the inner panel. The outer panel may provide a facing panel of the outer sleeve. The inner panel may be attached to the outer panel along a fold line, for example at an end thereof e.g. at the open end of the outer sleeve. This allows simple and accurate positioning of the inner panel relative to the outer panel.

The release button may be arranged such that pressing of the release button deflects the button out of the plane of the wall of the outer sleeve e.g. of the plane defined by an outer panel thereof. The button is deflected inwardly into the interior space of the outer sleeve. The release button may be arranged in any manner which permits the button to deflect to move the slider flap so as to move the locking edge of the flap to enable it to slide past the locking edge(s) of the outer sleeve wall when the slider is located appropriately with respect to the outer sleeve.

The release button may extend from a base region attached to the outer sleeve, towards the open end of the outer sleeve or towards the closed end of the outer sleeve. The release button may define a free distal end i.e. at an end thereof opposite the base. The distal end of the release button is spaced from the closed end of the sleeve.

In embodiments in which the base region is attached towards the open end of the outer sleeve, the release button may be arranged such that if the button is pressed with the slider fully inserted in the sleeve, and the slider then withdrawn from the sleeve, the slider flap rides up over the outside of the distal end of the release button. The slider flap is trapped between the release button and the sleeve wall. In this way, the release button limits the extent to which the slider may be withdrawn from the outer sleeve. The movement of the slider may be limited by engagement between the locking edge i.e. free edge of the slider flap and the base of the release button. The flap may then be trapped between the release button and the wall of the outer sleeve e.g. an outer panel thereof. If the user is to be able to unlock the package, they must slide the slider back to the fully inserted position, and then draw the slider out to a position intermediate the fully inserted and locked positions before pressing the release button.

The release button is preferably hingedly attached to the outer sleeve wall at the base region through a hinge line. The release button may be in the form of a tab connected to the outer sleeve at the hinge line. The orientation of the release button, and, where applicable, a hinge line connecting the button to the outer sleeve wall, may, for example, depend upon the orientation of the line of engagement between the locking edges of the sleeve wall and slider. The hinge line is preferably arranged parallel to the closed end of the outer sleeve. The location of the release button relative to the side edges of the outer sleeve may also be selected as desired e.g. depending upon the position of the locking edge(s) of the outer sleeve wall. The release button may be offset from a lateral centerline of the sleeve. The lateral centerline is the centerline defined between side edges of the sleeve. However, preferably the release button is arranged centrally between the side edges of the outer sleeve wall. However it is disposed, the release button is preferably integral with the wall of the outer sleeve, and, where the wall comprises inner and outer panels, with the outer panel thereof.

In preferred embodiments in which the outer sleeve wall comprises inner and outer panels, with the inner panel providing the one or more locking edge of the sleeve, preferably the release button is provided in the outer panel of the outer sleeve. The release button may be defined by a cutline in the outer sleeve wall e.g. in an outer panel thereof. However it is disposed, and regardless of the construction of the outer sleeve wall, one or more frangible bridges of material may be provided to maintain the release button in position before use. These bridges will be broken by a user upon first use of the package.

The or each locking edge of the set of one or more locking edges of the outer sleeve wall is preferably a two ply locking edge. This may provide a more robust locking arrangement, reducing the likelihood of failure of the lock, particularly when the release button is pressed with the locking edges of the sleeve and slider in engagement. In particularly preferred embodiments the or each locking edge is formed as a folded edge. This enables a two ply edge to be provided in an efficient manner, and may enable the outer sleeve to be provided by a single blank of sheet material. In preferred embodiments in which the outer sleeve wall comprises inner and outer panels, the or each two ply locking edge of the outer sleeve wall may be provided by a folded edge defined between the inner panel and one or more distal flap connected along a fold line thereto. Each (folded) distal flap may be located between the inner panel and the outer panel of the wall. In preferred embodiments a single distal flap is provided. This may facilitate manufacture. Where a pair of double ply locking edges is provided, each locking edge may be provided by a folded edge defined between the inner panel and a single distal flap connected along a fold line thereto. Of course, it may be envisaged that respective distal flaps might be provided for each locking edge.

In embodiments in which the outer wall comprises inner and outer panels, and the or each locking edge of the set of one or more locking edges of the outer wall is provided at a terminal end of the inner panel, the or each locking edge may be unsecured to the outer panel. Where the or each edge is provided by a folded edge defined between the inner panel and one or more distal flap connected thereto, the or each distal flap being located between the inner panel and the outer panel, the or each distal flap may be unsecured to the outer panel of the wall or attached only at a region remote from the locking edge. The distal flap may be secured only to the inner panel. It has been found that providing a locking edge that is unsecured to the outer sleeve wall a least in the region of the locking edge may allow the locking edge (s) of the slider to slide under the locking edge(s) of the outer sleeve, thereby improving their locking engagement if a user simply tries to pull the slider out of the outer sleeve.

Such an arrangement, with an unsecured flap is considered of importance in its own right so from a further aspect, the invention provides a package comprising: an outer sleeve having an open end and a closed end; a slider for holding a blister pack, the slider being slidably mounted within the outer sleeve; the outer sleeve comprising a wall having a set of one or more locking edges arranged on the interior of the wall at a spacing from the closed end of the sleeve and facing the closed end of the sleeve; the slider comprising a locking flap formed at a terminal end of the slider and extending in a direction away from the closed end of the outer sleeve for engagement with the said wall of the outer sleeve, the flap having a free edge which provides a locking edge for engagement with the or each locking edge of said set of one or more locking edges of the outer sleeve wall to thereby prevent the slider from being withdrawn from the outer sleeve in a locked position; wherein the outer sleeve further comprises a release button, wherein pressing of the release button deflects the slider flap away from said wall of the outer sleeve so as to enable the free edge of the slider flap to slide past the or each locking edge of the set of one or more locking edges of the outer sleeve thereby allowing the slider to be withdrawn from the outer sleeve; wherein the outer sleeve wall has an outer panel and an inner panel, the set of one or more locking edges of the outer sleeve wall being formed at a terminal end of the inner panel, and wherein the inner panel is not secured to the sleeve outer wall adjacent the one or more locking edges, whereby the slider flap may engage under the one or more locking edges.

The outer sleeve wall may further comprise a backing tab which at least partially overlaps the base region end of the release button. This may add a degree of resilience to the release button, encouraging the button to return to its original position after being released. Preferably the backing tab only partially overlaps the release button. The added resilience which may be provided by the backing tab helps to reduce the extent to which the base region of the tab may move. This may be used to help prevent pressing of the release button when the locking edges of the sleeve wall and slider are engaged from resulting in sufficient movement of the flap of the slider to deflect the locking flap of the slider and disengage the locking edges of the slider and outer sleeve wall. In preferred embodiments in which the outer sleeve wall comprises inner and outer panels, preferably a terminal end of the inner panel of the outer sleeve wall comprises the backing tab. The backing tab is preferably defined by a cutout in the inner panel. In preferred embodiments in which the outer sleeve wall comprises inner and outer panels, the or each locking edge of the outer sleeve wall being a two ply edge provided by a folded edge defined between the inner panel and a distal flap connected along a fold line thereto, the backing tab may be defined by a cut out extending from the inner panel into the distal flap. However it is constructed, the backing tab is preferably of a single ply. This may help to avoid it interfering with the lock provided by the locking edges of the outer sleeve and the slider.

The outer sleeve wall may comprise only a single locking edge for cooperating with the free edge of the slider flap to prevent withdrawal of the slider from the sleeve by more than the predetermined amount. Thus the set of one or more locking edges of the outer sleeve wall may include only a single locking edge. The locking edge may extend laterally inwardly from a first side edge of the wall of the outer sleeve toward a second side edge thereof (or, in preferred embodiments in which the outer sleeve wall comprises inner and outer panels, from a first side edge of the inner panel thereof toward a second side edge thereof). The release button may then be located between the locking edge and a second side edge of the wall (or inner panel). Where the outer sleeve wall comprises inner and outer panels, and a backing tab is provided which at least partially overlaps a base region end of the release button, the backing tab may be arranged to be in a recess between the locking edge and the second side edge of the inner panel. At least a portion of the release button may additionally extend into such a recess. In embodiments in which the set of one or more locking edges of the outer sleeve wall is a single locking edge, the release button may therefore be offset from a (lateral) center of the outer sleeve wall. However, this is not necessarily the case. For example, the locking edge and/or the release button may still be centrally located.

However, in particularly preferred embodiments, the set of one or more locking edges of the outer sleeve wall comprises first and second locking edges, the first and second locking edges being (laterally) spaced from one another. The set may comprise a pair of locking edges. Preferably only a pair of locking edges is provided. However, it is envisaged that more than two locking edges could be used. Preferably these embodiments include a backing tab which at least partially overlaps a base region end of the release button, and the backing tab is located between the first and second locking edges. The first and second locking edges may extend laterally inwardly from respective side edges of the outer sleeve wall. In particularly preferred embodiments in which the outer sleeve wall comprises inner and outer panels, the terminal end of the inner panel defines the first and second locking edges and the backing tab. Where no backing tab is provided, it is envisaged that the terminal end of the inner panel may define a recess, and at least a portion of the release button may extend into the recess. For example, a base of the release button may extend into the recess.

The wall of the outer sleeve may further comprise a retaining flap formed at the open end of the outer sleeve for engagement with the slider locking flap to prevent full withdrawal of the slider from the outer sleeve.

In an advantageous arrangement in which the outer sleeve wall comprises inner and outer panels, the retaining flap is formed as a hinged flap released from the inner panel.

The locking flap of the slider is preferably a two ply locking flap. The locking flap is hingedly connected to a panel of the slider about a fold line. In preferred embodiments the free edge of the locking flap is a folded edge. The folded edge may be defined between a first panel connected to the panel of the slider about a fold line, and a distal flap connected to the distal end of the first panel and secured thereto to create a double ply flap.

In preferred embodiments a tongue is connected to the slider panel having the locking flap connected thereto about the same fold line about which the locking flap is connected to the slider panel, and extends away from the outer sleeve wall having the set of one or more locking edges toward an opposite wall of the outer sleeve. The tongue and locking flap thus extend in opposite directions. The tongue is preferably released from a panel of the locking flap. The locking flap may be defined by one or more panels. Where the flap is two ply, the panel of the flap from which the tongue is released will be the panel closest to the opposite wall of the outer sleeve. The locking flap comprises at least a flap connected to a panel of the slider along a fold line. The tongue is preferably released from this panel. As described above, where the locking flap is two ply, the flap may additionally comprise a distal flap connected to the flap panel from which the tongue is released. The presence of the tongue may help to bias the locking flap into engagement with the wall of the outer sleeve having the locking edges, and hence promote locking. The tongue will also help to reduce the extent to which the slider may be moved within the outer sleeve in the direction connecting the outer sleeve wall having the locking edge(s) and an opposite wall, reducing the ability to disengage the locking edges. This may also help to maintain the slider within the outer sleeve by making it more difficult to manipulate the slider in a way to try to disengage the locking flap from the retaining flap of the outer sleeve. The tongue may also act to bias the slider flap in the direction of engagement with the sleeve flap. The provision of a tongue is only optional.

The slider may comprise a first leaf remote from the wall of the outer sleeve having the set of one or more locking edges, and a second leaf adjacent the wall of the outer sleeve, the first leaf and second leaf joined at an end adjacent the open end of the outer sleeve, the slider flap extending from the first slider leaf towards the outer sleeve wall. The slider flap is connected to the first slider leaf about a fold line. One or both of the first and second leafs hold a respective blister pack. In preferred embodiments, the first leaf holds a first blister pack, and the second leaf holds a second blister pack. In embodiments in which the slider further comprises a tongue, the tongue extends from the first slider leaf towards an opposite wall of the sleeve (i.e. opposite the wall having the set of one or more locking edges).

The first and second leaves of the slider may be joined by an end wall at adjacent the open end of the outer sleeve. The slider may comprise a pair of flaps extending from the side edges of the end wall toward the closed end of the sleeve. Such flaps may help to inhibit rollout of the end wall of the slider when the slider is fully inserted in the outer sleeve, making it more difficult for a child to attempt to access the contents of the blister pack(s) in this way. This provides a further level of child resistance. Such flaps may be in accordance with any of the embodiments described in EP 3015398A1.

In embodiments the outer sleeve may further comprise removable tabs at its open end for providing one or more notches (i.e. finger notches) to provide access to an end of the inserted slider. Such tabs would be removed by a user when he or she wishes to remove the slider so as to allow the user to grip the end of the slider.

In embodiments, the tabs may be formed on opposed walls of the sleeve. This may provide opposed gripping notches.

In embodiments, the tabs may be elongated in a direction along the wall of the sleeve to produce an elongated notch i.e. an elongated finger notch. This may be advantageous in that it permits the user to grip the slider easily even when it has been further inserted into the sleeve into its intermediate position.

To facilitate removal of the slider, the sleeve and/or slider may be provided with an indication of the appropriate intermediate position. In one embodiment, the indication may comprise a marking on the sleeve against which a marking on the slider or an end wall of the slider may be aligned. In the arrangements described above, the marking may be provided adjacent a finger notch. In some embodiments, the marking may be a simple line on the sleeve for alignment with a line on the slider or with the end thereof. The marking could also be a physical marking such as a notch in an edge of the finger notch, created when the tab is removed to create the finger notch. Other marking such as colored regions of the sleeve and/or slider may be provided.

The present invention extends to a blank of foldable sheet material for providing the outer sleeve of the present invention in any of its embodiments.

The blank is preferably a single piece blank.

The present invention extends to a blank of foldable sheet material for providing the slider of the present invention in any of its embodiments.

The blank is preferably a single piece blank.

A fold line as referred to herein refers to any line about which components have been folded. The fold line may comprise a line of weakness, crease line and/or perforations. If not explicitly stated, and unless inconsistent therewith, any connection described herein may be about a fold line.

The slider and outer sleeve are each made from a foldable sheet material such as paperboard, cardboard or other lightweight foldable sheet material. However, any suitable sheet material may be used, for example a plastics material. The outer sleeve and slider may each comprise any suitable arrangement of construction flaps or other means to retain the respective parts in their dimensional states.

The present invention in accordance with any of its further aspects or embodiments may include any of the features described in reference to other aspects or embodiments of the invention to the extent it is not mutually inconsistent therewith.

BRIEF DESCRIPTION OF THE DRAWINGS

Some preferred embodiments of the invention will now be described by way of example only with reference to the accompanying drawings, in which.

DETAILED DESCRIPTION OF THE INVENTION

Figure 1:
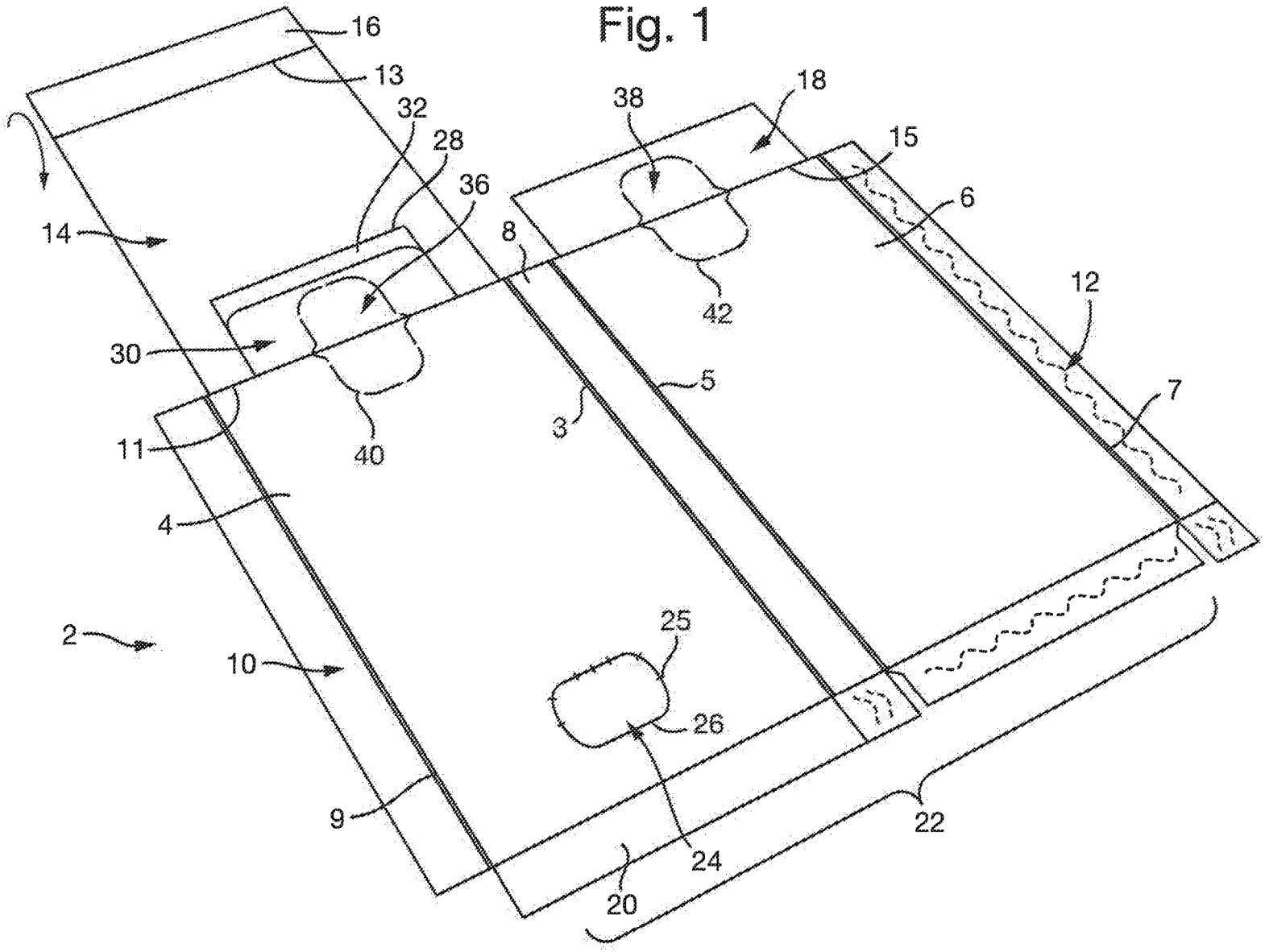
FIG. 1 illustrates a blank for constructing the outer sleeve of a package in accordance with an embodiment of the invention.

FIG. 1 illustrates a blank 2 in the flat for providing the outer sleeve of a package in accordance with the invention. The blank is of paperboard or other foldable sheet material as known in the packaging art. It will be appreciated that certain glue flaps may be provided with perforations to aid glue penetration and thus facilitate adhesion. FIG. 1 shows the blank from the top side in the flat which will provide the interior of the sleeve.

The blank includes a first panel 4 and a second panel 6 for providing first and second opposed facing panels of the sleeve. The blank comprises a third panel 8 for providing one sidewall of the sleeve, and a fourth panel 10 for providing an opposed sidewall thereof. The first and second panels 4, 6 are connected via first and second fold lines 3, 5 to opposed side edges of the third panel 8. A glue flap 12 is connected to the second panel 6 along a third fold line 7. The fourth panel 10 is connected along a fourth fold line 9 to the first panel 4.

A fifth panel 14 is connected along a fifth fold line 11 to the first panel 4. A distal flap 16 is connected along a sixth fold line 13 to the fifth panel 14. A flap 18 is connected along a seventh fold line 15 to the second panel 6.

The blank also includes an array of flaps 22 for providing a closed bottom end to the outer sleeve. The array of flaps includes a flap 20 which provides the bottom end wall of the sleeve.

Some particular features of the panels will now be described.

The first panel 4 includes a release button 24 connected to the first panel 4 via frangible bridges which are broken on first use of the package by a user to enable the release button to be deflected inwardly toward the interior of the sleeve. The release button is hingedly connected to the panel 4 along a hinge line 26 at the base of the button.

The fifth panel 14 includes a cutline 28 which defines a flap 30.

A cutout 32 also is provided between the flap 30 and the fifth panel 14.

The first and second panels 4, 6 are also provided with removable tabs 36, 38 defined by arcuate lines of weakness 40, 42, which extend into the flap 30 defined in the fifth panel 14 and the flap 18 respectively. The tabs 36, 38 may be of any shape, for example D shaped as shown or semi-circular. Preferably the tabs 36, 38 are elongated in a direction along the sleeve 14.

Erection of the outer sleeve from the blank of FIG. 1 will now be described. For ease of reference, the surface of the blank, and the panel/flaps thereof visible in FIG. 1 will be referred to as the interior surface thereof, with the opposite surface of the blank (and the panels/flaps thereof) being referred to as the exterior surface.

Figure 2:
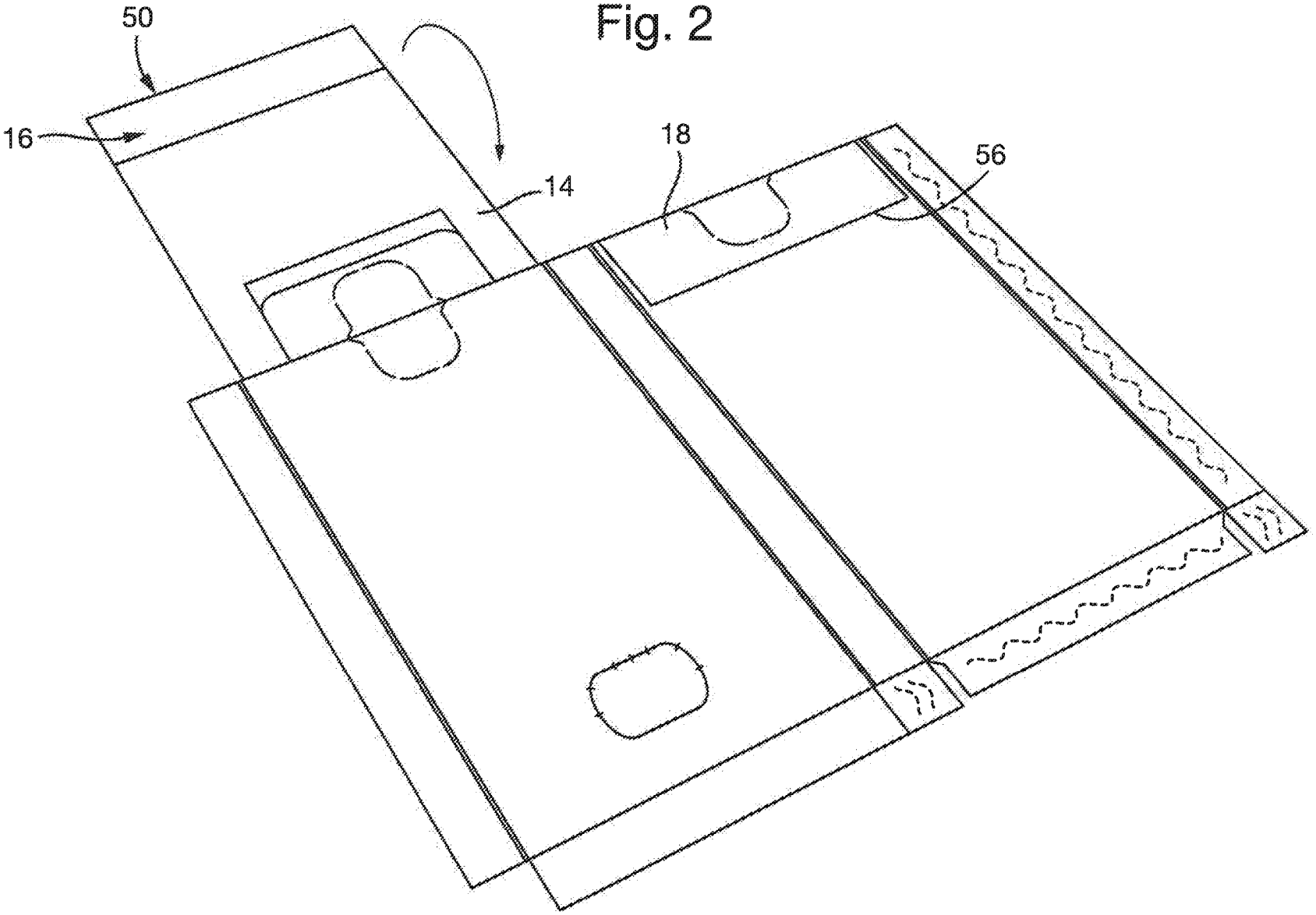
FIG. 2 shows a stage in the erection of the blank of FIG. 1.

In a first step, as shown in FIG. 2, the distal flap 16 is folded about the sixth fold line 13 (in the direction shown in FIG. 1) and glued onto the interior of the fifth panel 14. This defines a double ply locking edge 50. The flap 18 is folded about the seventh fold line 15 and glued to the interior of the second panel 6. This defines a locking edge 56 on the interior of the second panel 6.

Figure 3:
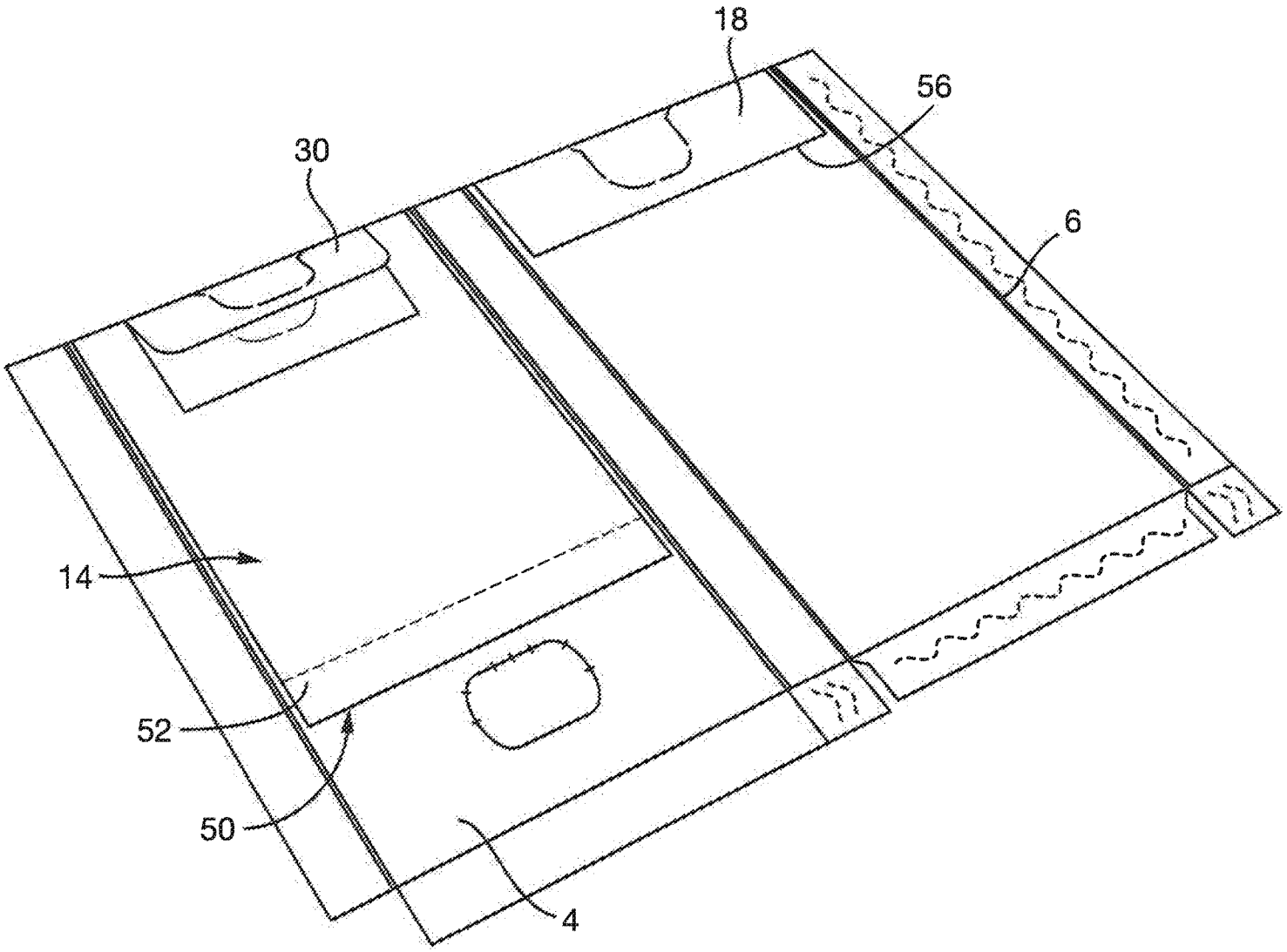
FIG. 3 shows a further stage in the erection of the blank of FIG. 1.

In a second step, as shown in FIG. 3, the fifth panel 14 is folded about the fifth fold line 11 (in the direction shown on FIG. 2) on to the inner surface of the first panel 4 and glued in position. In this way the double ply edge 50 defines a double ply locking edge associated with the inner surface of the wall 104 of the sleeve. An end region 52 of the fifth panel 14 may not be glued to the inner surface of the first panel 4 for reasons which will be described further below.

The wall of the sleeve includes inner and outer panels defined by the panel 14 and the panel 4 respectively. The flap 30 is released from the panel 14, and is folded so as to be positioned as shown in FIG. 3, such that it extends towards the end of the first panel 4 which will correspond to the closed end of the sleeve.

Figure 4:
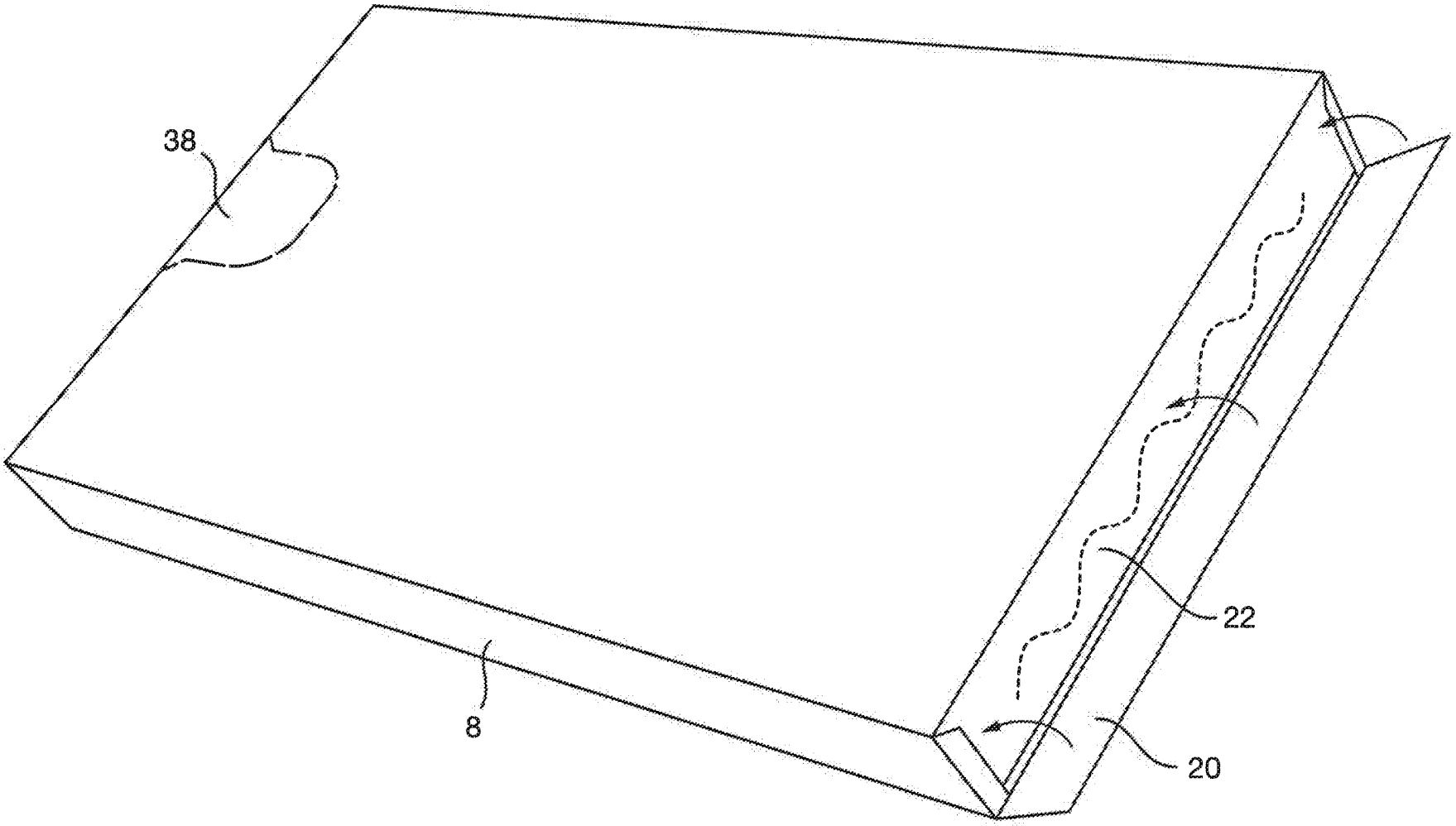
FIG. 4 shows the substantially fully erected outer sleeve obtained from the blank of FIG. 1.
Figure 7:
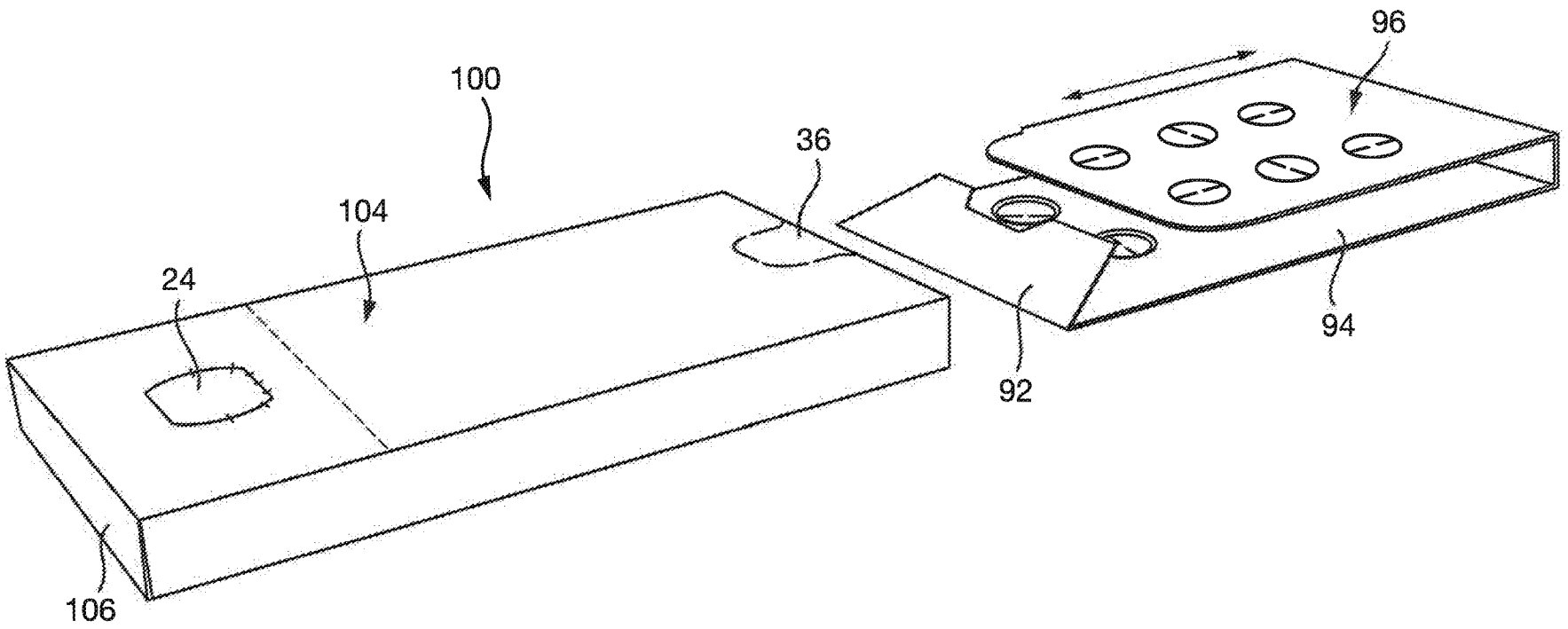
FIG. 7 shows the fully erected outer sleeve and slider prior to engagement.

The glue flap 12 is then adhered to the interior surface of the fourth panel 10 to provide a partially erected sleeve as shown in FIG. 4. The array of flaps 22 are then folded and glued to provide a closed bottom end of the sleeve, resulting in a fully erected sleeve 100 as shown in FIG. 7. The sleeve has a first wall 104 which has the locking features for preventing withdrawal of the slider by more than a predetermined amount associated with the inner surface thereof. The wall is defined by the inner panel provided by the panel 14 and the outer panel, provided by the first panel 4. The panel 4 provides a facing panel of the sleeve. An opposite second wall is provided by the panel 6, which provides an opposite facing panel of the sleeve, while the panel 20 provides an end wall 106 of the sleeve. The first and second walls therefore provide main faces of the outer sleeve.

It will be appreciated that the sequence of operations involved in producing the sleeve may be varied, and the above described method is only exemplary. For example, the different panels and/or flaps may be folded in a different order and/or simultaneously. The lines of weakness 40, 42 define tabs which may be removed by a user to define notches in the upper edge of the facing panels of the sleeve as the first stage of opening the package as described below.

Figure 8:
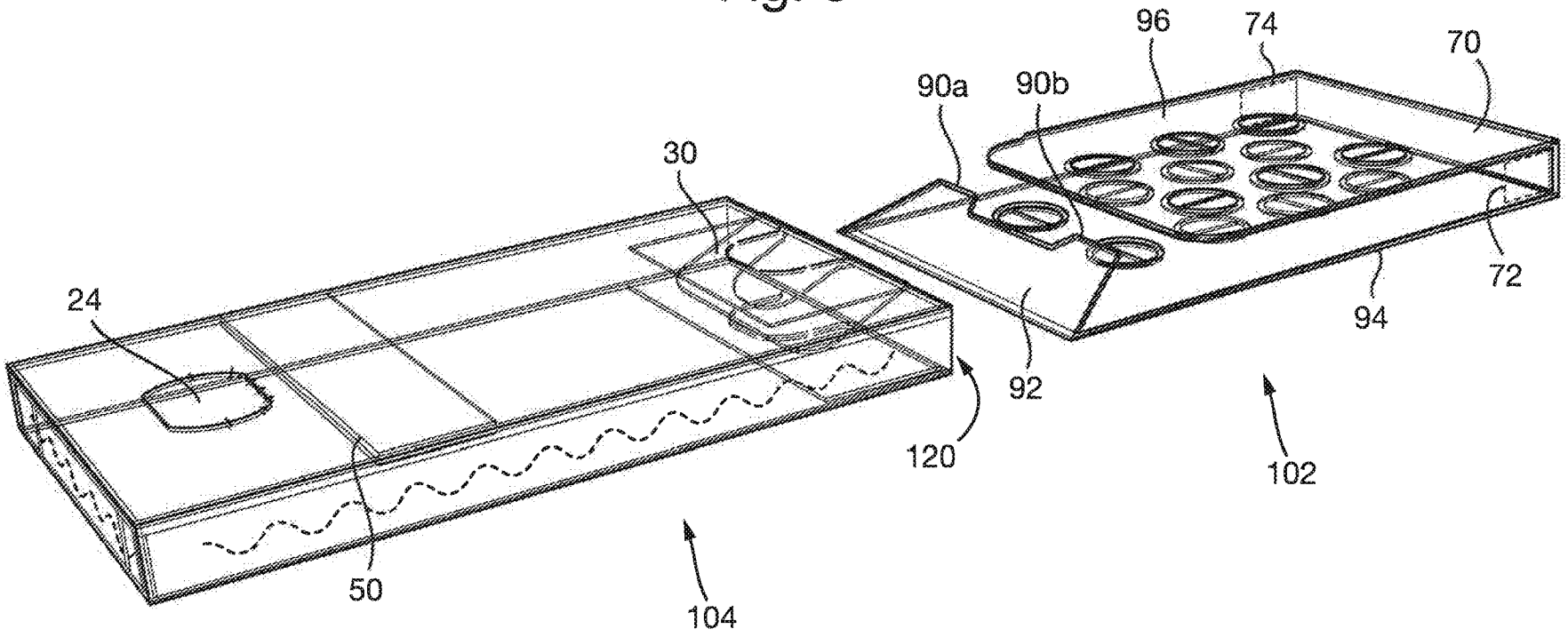
FIG. 8 corresponds to FIG. 7, but showing hidden detail.

FIG. 8 shows the arrangement of the flap 30 at the open end of the sleeve 100 in more detail, showing how it extends back toward the closed end of the sleeve.

A blank 60 in the flat for providing a slider 102 of the package 100, and its erection to provide the slider, will now be described.

Figure 5:
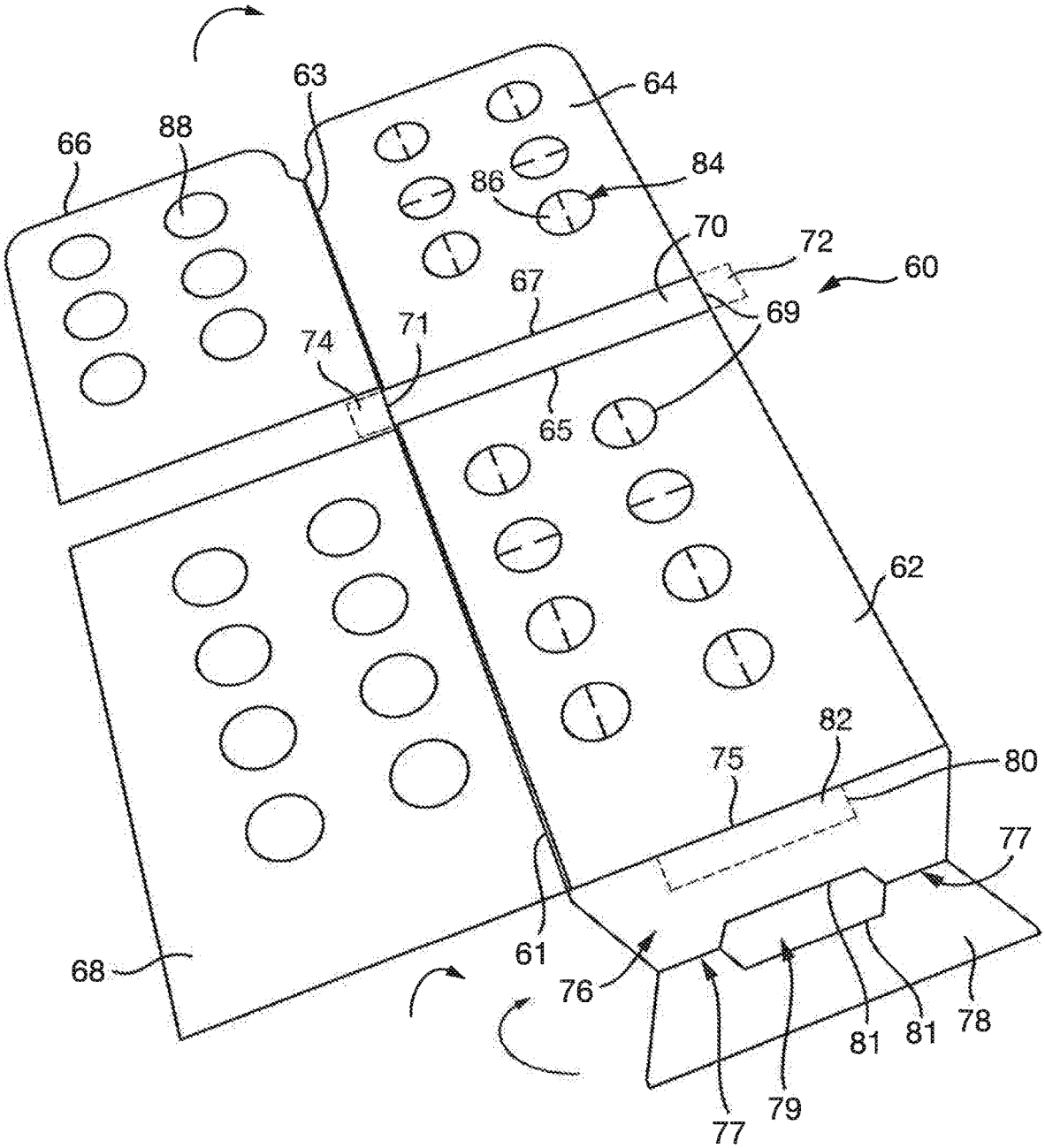
FIG. 5 illustrates a blank for providing a slider in accordance with one embodiment for a package of the invention

FIG. 5 illustrates the blank 60 from the interior surface thereof. The blank 60 includes a first panel 62, a second panel 64, a third panel 66 and a fourth panel 68. The first and fourth panels 62, 68 are connected along a first fold line 61, while the second and third panels 64, 66 are connected along a second fold line 63. A fifth panel 70 is connected along respective third and fourth fold lines 65, 67 to the first and second panels 62, 64 respectively. Optional flaps 72, 74 (shown in dotted lines) may extend from the side edges of the fifth panel 70, and are connected thereto along fifth and sixth fold lines 69, 71. A flap 76 is connected to the end of the first panel 62 opposite that which is connected to the fifth panel 70, and is connected thereto along the seventh fold line 75. A distal flap 78 is connected along an eighth fold line 77 to the flap 76. A cut out 79 is provided along the eighth fold line 77 defining respective recesses 81 in the flap 76 and distal flap 78 respectively.

The slider 102 provides a carrier for a blister pack. The first and second panels 62, 64 are provided with a number of pairs of semi-circular removable tabs 84, 86 defined by perforations. Each pair of tabs must be removed by the user to define a circular dispensing opening in order to dispense the content of a blister. This provides added child resistance. Of course, different shaped tabs may be used, and a single tab may be used to cover a single opening. The third and fourth panels 66, 68 include a plurality of openings 88 to receive the blisters of a blister pack.

The flap 76 optionally includes a cutline 80 (shown in dotted lines) which will define a tongue 82 hingedly connected to the first panel 62 along a portion of the seventh fold line 75.

Figure 6:
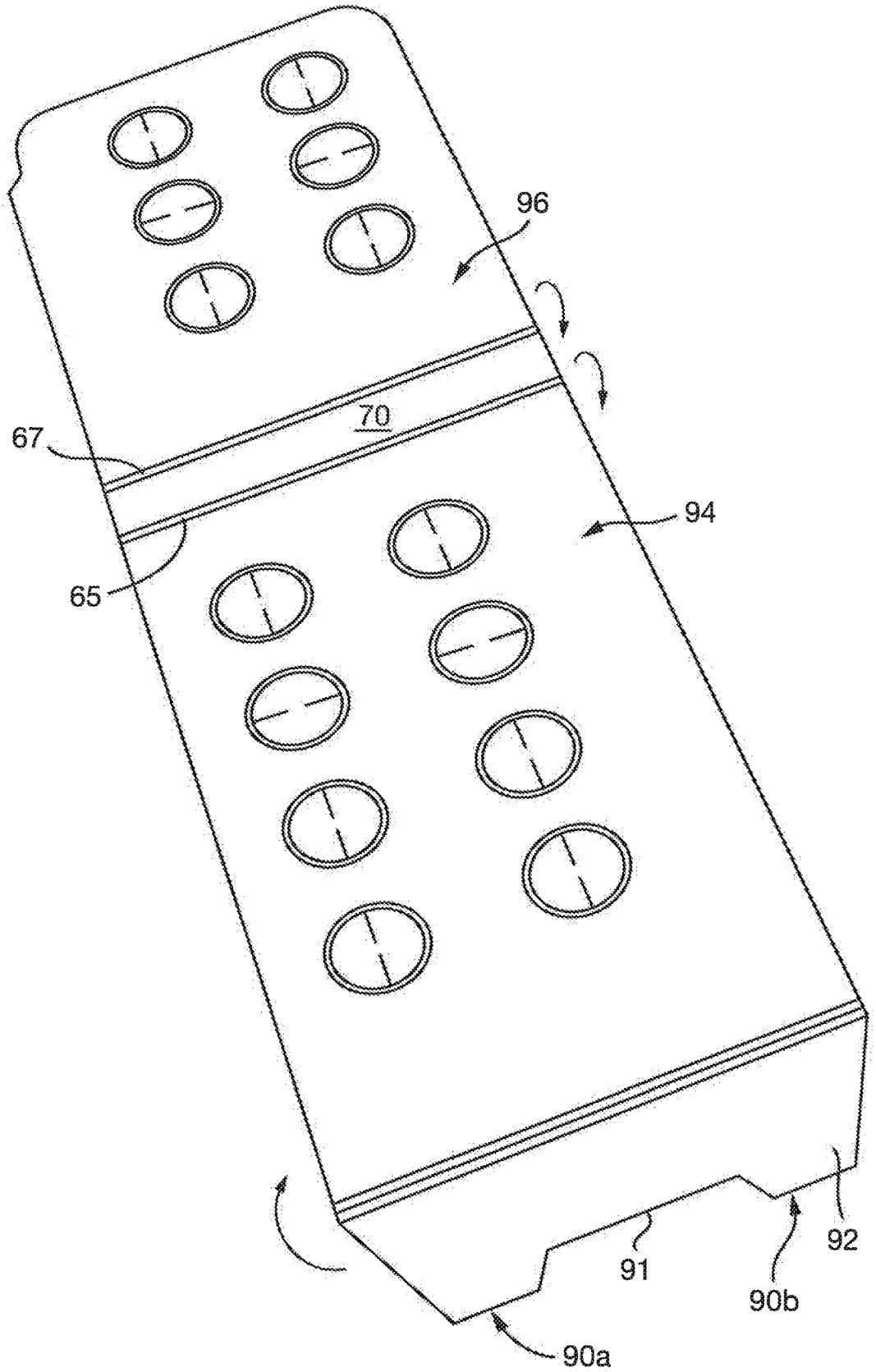
FIG. 6 shows a stage in the erection of the blank of FIG. 8.

The erection of the blank 60 to provide a slider 102 will now be described with reference to FIGS. 5, 6 and 7.

The distal flap 78 is folded in the direction shown in FIG. 5 on to the interior of the flap 76 and glued in place. The area of the flap 76 that will define the tongue 82 is left free from glue. This defines a double ply flap 92, as shown in FIG. 6 whose folded edge provides a double ply locking edge. As can be seen from FIG. 6, a recess 91 is defined in the fold line between two locking edge portions 90*a*, 90*b*.

Blister packs (not shown), are then placed on the inner surfaces of the first and second panels 62, 64, with the flat surface of the blister packs facing the panels, and the dispensing parts of the blister pack overlying the positions of the dispensing openings that will be provided in the panels 62, 64 on removal of the pairs of tabs 84, 86 defining covers.

The fourth panel 68 is then folded over the first panel 62 in the direction shown in FIG. 5, and heat sealed or glued in position to trap the blister pack between the first and fourth panels. Likewise, the third panel 66 is folded over the first panel 64 in the direction shown in FIG. 5, and heat sealed or glued in position to trap a blister pack between the second and third panels. The blisters of the blister packs extend through the openings 88 in the third and fourth panels. The resulting partially erected blister pack carrier is as shown in FIG. 6 (blister packs not shown for clarity). The blister pack carrier has first and second panels, 94, 96 formed from the first and fourth, and second and third panels of the blank respectively.

Figure 10:
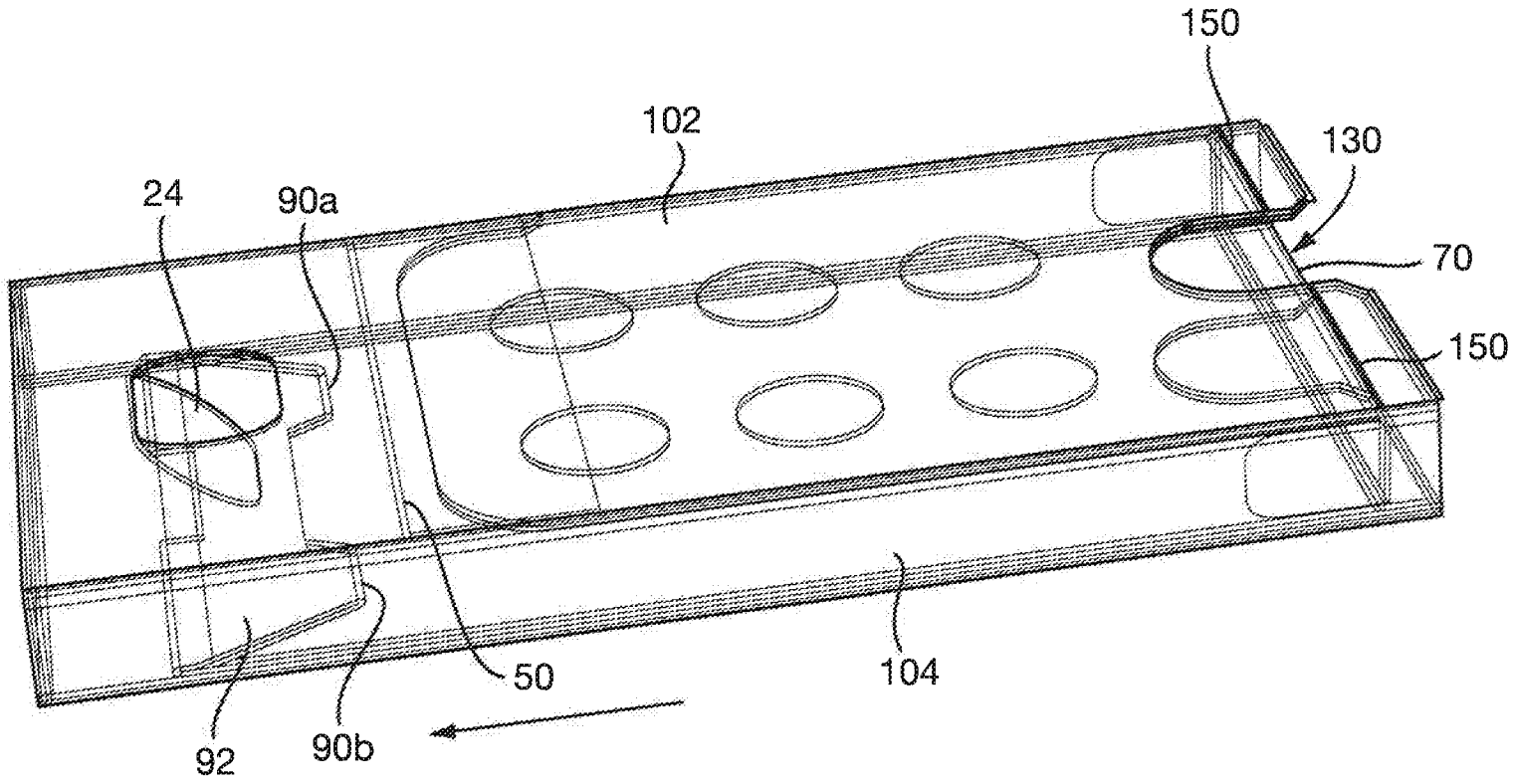
FIG. 10 shows the package of FIG. 9, in an unlocking position.

Next, as shown in FIG. 7, which illustrates the erected slider 102, the double ply flap 92 made up of the flaps 76, 78 is folded in the direction shown in FIG. 10 toward the surface of the first panel 94. The tongue 82 defined by the cutline 80 (if present) may be folded toward the opposite surface of the panel 94. The partially erected slider of FIG. 6 is also folded in the direction shown in FIG. 10 about the third and fourth fold lines 65, 67 to fold the second panel 96 over the first panel 94, and define an end wall 70 of the slider. The tabs 72, 74 (if present) may be folded back along the sides of the blister pack carrier toward the end having the double ply flap 92.

As with the outer sleeve, the sequence of operations in erecting the slider from the blank may be varied, and the above process is merely exemplary.

Assembly of the outer sleeve 100 and the slider 102 will now be described.

The slider 102 is inserted into the open top end of the sleeve 100 with the double ply flap 92 leading as shown in FIGS. 7 and 8. The flap 92 faces the first facing panel 4 having the release button 24 and the flap 30 at the top end thereof. Once the double ply flap 92 has been inserted past the flap 30, the flaps will interact with one another to prevent complete withdrawal of the slider from the sleeve. This is described in more detail below. The tongue 82 (if present) may engage the locking edge 56 provided by the flap 18 associated with the second facing panel 6. This provides a further level of child resistance making it more difficult to disengage the cooperating retaining flaps 92, 30. The tongue 82 may also act to bias the first panel upwardly.

FIG. 8 is illustrates the operation of the lock for preventing complete removal of the slider from the sleeve in more detail. FIG. 8 also illustrates the components of the sleeve 104 which provide the lock for preventing withdrawal of the slider 102 from the sleeve 104. These features include the locking edge 50 defined by the flap 16 and the fifth panel 14, and the release button 24. This lock has a line of engagement indicated X-X defined by the position of the locking edge 50.

Figure 9:
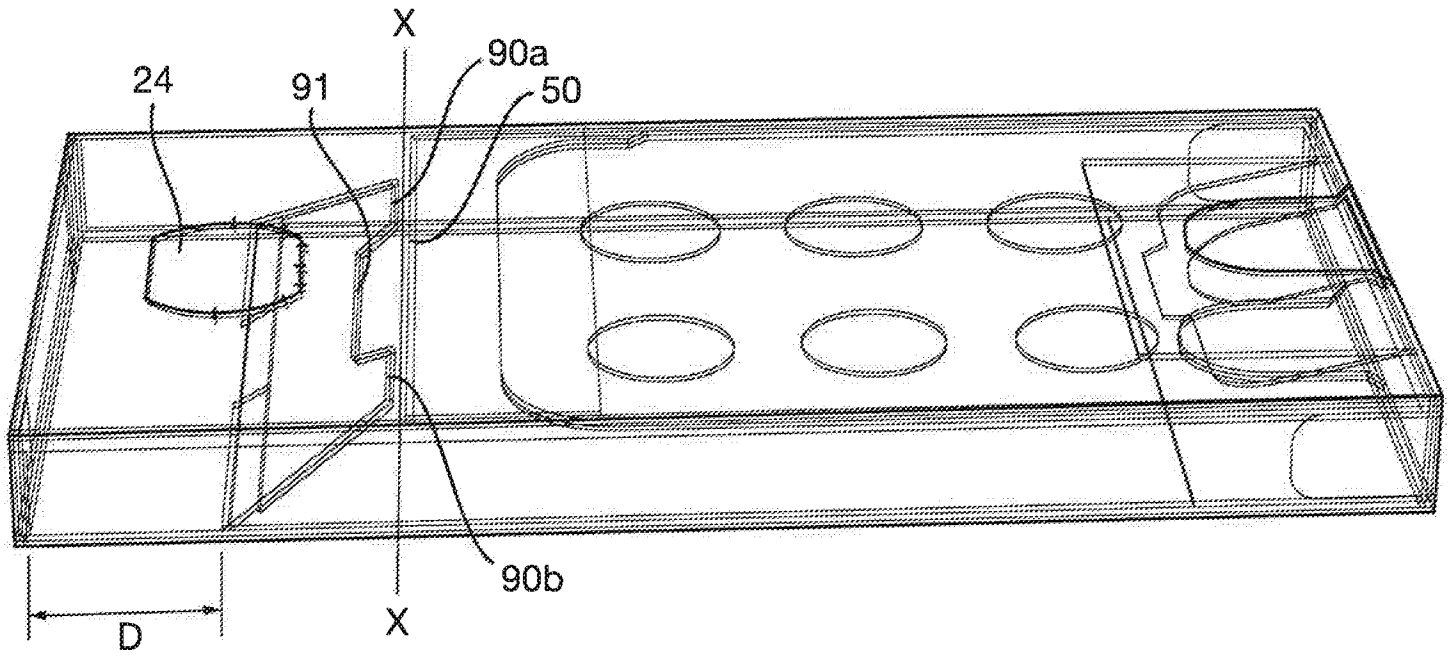
FIG. 9 shows the outer sleeve and slider assembled to form a package in accordance with the invention, showing hidden detail.

The slider 102 is slid into the sleeve 100 as shown in FIG. 9. Either substantially as, or at some point before reaching the position shown in FIG. 9, in which the fifth panel 70 of the slider 102 lies in the plane of the open end 120 of the outer sleeve 104, the double ply flap 92 of the slider 102 passes over the double ply locking edge 50 of the sleeve 104. This may produce an audible click indicating to a user that the package is locked. The locking engagement may therefore occur at some point before the slider 102 reaches the position of FIG. 9, meaning that in certain embodiments, the slider 102 can be withdrawn a limited amount from the position shown in FIG. 9 so that the slider 102 protrudes from the sleeve 104. However, the amount by which the slider 102 protrudes from the sleeve 104 is insufficient for a use to gain access to the contents of the slider 102.

In the closed position of the package shown in FIG. 9, the slider 102 is not fully located fully within the sleeve 104 and there is a space D between the fold line 75 at the base of the double ply panel 92 of the slider 102 and the end wall 20 of the outer sleeve 104. The end wall 70 of the slider 102 closes the top end of the slider 104. The tabs 72, 74 (if present) are within the slider 102, and provide an additional level of child resistance by acting to inhibit outward rolling of the end wall 70 of the slider. This may help to prevent a child obtaining access to blisters by rolling out the end wall 70 of the slider 102.

The condition shown in FIG. 9 is the condition in which the package 100 would be shipped to a user by a manufacturer.

In order to gain access to the content of the blister pack, several steps need to be taken by the user.

First the user must remove the removable tabs 36, 38 to provide elongated finger notches 130 in the top end of the facing panels 4, 6 of the sleeve to enable the top end of the slider 102 to be gripped. If the user now tries to pull the slider from the sleeve, the slider 102 will only be able to move only a relatively small distance out of the sleeve 104 before the locking edges 90*a*, 90*b* of the double ply flap 92 of the slider engages against the double ply locking edge 50 of the sleeve 104. This distance is insufficient to provide access to the blisters. As the end region 52 of the inner panel 14 of the sleeve wall is not glued to the inner wall, if a user pulls very hard on the slider 102, then the locking edges 90*a*, 90*b* may slide under the double ply locking edge 50, thereby more firmly engaging one with the other, making it harder to withdraw the slider 102.

In order to be able to withdraw the slider 102, the user must depress the release button 24. Initially this will involve breaking the frangible line of weakness 26 to allow the release button 24 to be deflected into the slider. However, this step will only be effective to allow the slider 102 to be withdrawn further from the sleeve 104 if performed with the slider 102 at a particular position relative to the sleeve 104.

The package is thus constructed such that the slider 102 must be in a particular position relative the sleeve 104 in order for the release button to function to deflect the locking edges 90*a*, 90*b* of the flap 92 inwardly to allow it to clear the locking edge 50 as the slider 102 is withdrawn from the sleeve 104.

In order to permit withdrawal of the slider 102 by an amount sufficient to gain access to the blister pack, rather counter-intuitively, the slider 102 must be inserted further into the sleeve 104, as shown in FIG. 10. This position may be a position intermediate a position in which the slider 102 is fully inserted in the sleeve 104, and the locking position.

In a fully inserted position, the button 24 if depressed, will not engage with the flap 92 at all, or may not engage sufficiently therewith that pressing on the button 24 will not deflect the flap 92, thereby preventing disengagement of the locking edges 90*a*, 90*b*, 50. The presence of the recess 91 in the flap 92 may facilitate this non-engagement of the button 24 with the flap, the recess 91 optionally being aligned with the button 24 when the slider 102 is in the closed position.

If the slider is in a locked position with the locking edges 90*a*, 90*b*, 50 of the slider 102 and sleeve 104 engaged, pressing the release button 24 inwardly will not deflect the locking edges 90*a*, 90*b* of the slider flap 92 out of abutment with the double ply locking edge 50. In this position, the base of the release button 24 is unable to deflect to the extent necessary to disengage the locking edges 90*a*, 90*b* of the slider flap 92 from the locking edge 50 of the sleeve 104.

Figure 11:
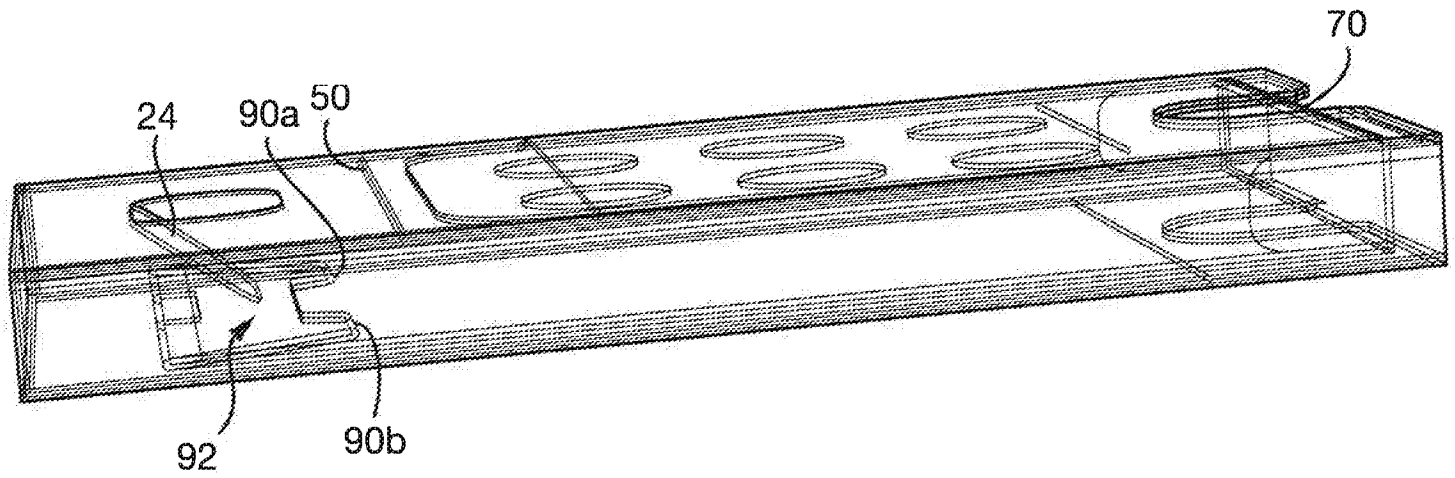
FIG. 11 shows the same as FIG. 10, but from a different view.

In order to open the package and obtain access to the content of the blister packs, the user must first slide the slider 102 to a position intermediate the fully inserted position and the locked position, before pressing the release button 24. Such a position is shown in FIG. 10. In this position, the end wall 70 of the slider 102 lies within the sleeve 104. However, the slider 102 is still accessible for gripping purposes through the notches 130 formed by the removal of the tabs 36, 38. In this position, the release button 24 overlaps the flap 92 and pressing the release button 24 will deflect the flap 92 and its locking edges 90*a*, 90*b* inwardly, so that the locking edges 90 of the slider 102 may clear the locking edge 50 of the sleeve as the slider is further withdrawn. The withdrawal should be effected relatively quickly such that the flap 92 does not spring back into contact with the locking edge 50 as it is withdrawn. FIG. 11 shows the same as FIG. 10, but from a different view.

To assist the use in movement of the slider 102 to the appropriate position, the sleeve 104 and/or slider 102 may be provided with suitable alignment markings. For example, as shown in FIGS. 10 and 11, the sleeve 104 may have a marking 150 on one or more sides of the notch 130 with which a marking on one of the slider panels 94, 96 or the end wall 70 of the slider should be aligned. In the embodiment illustrated, the marking 150 is simply a line provided on the sleeve on one or both sides of the finger notch 130. However, other markings, such as colored regions of the sleeve 104 may be provided as appropriate.

The slider 102 may then be slid out of the sleeve 104 until the slider flap 90 engages the retaining flap 30 at the open end of the sleeve. In this position, the tongue 82 may also engage the locking edge 56 provided by flap 18 to further assist with retaining the slider 102 in the sleeve 104, and to prevent disengagement of the retaining flaps. The top panel 96 of the slider 102 will be positioned completely outside the sleeve 104 such that it may be folded back to provide access to the blister pack provided therein and in the lower panel 94. In order to dispense the content of a blister, the user must first remove the removable tabs 84, 86 covering each dispensing opening in the panels 94, 96 to enable the content of a blister to be pressed out of the blister pack.

The user may then refold the slider, and slide it back into the sleeve until it is in the closed position illustrated in of FIG. 9, until it is desired to access the content of the slider again. As mentioned above, the act of closing the package 100 may produce an audible click when the flap 92 passes over the locking edge 50, indicating to the user that the package is locked.

If the user inadvertently pushes the slider 102 fully into the sleeve 104, as discussed above the package cannot be opened and the user will have to move the slider 102 to the desired intermediate positions in which the release button 24 overlaps or sufficiently the slider flap 92 to be able to deflect it as required to allow the slider flap locking edges 90*a*, 90*b* to clear the locking edge 50 of the sleeve 104.

It will be appreciated that various modifications to the above arrangements may be made within the scope of the invention. The shape of the dispensing openings, and any covers, or segments therefor where applicable, may be selected as desired e.g. depending upon the shape of the blister contents, and need not be of the shapes illustrated. Further it should be understood that the various panels referred to herein may be formed from one or more sub panels. In addition it is envisaged that the sleeve and/or slider might be provided using separate blanks attached to one another, rather than from single piece blanks.

Figure 12:
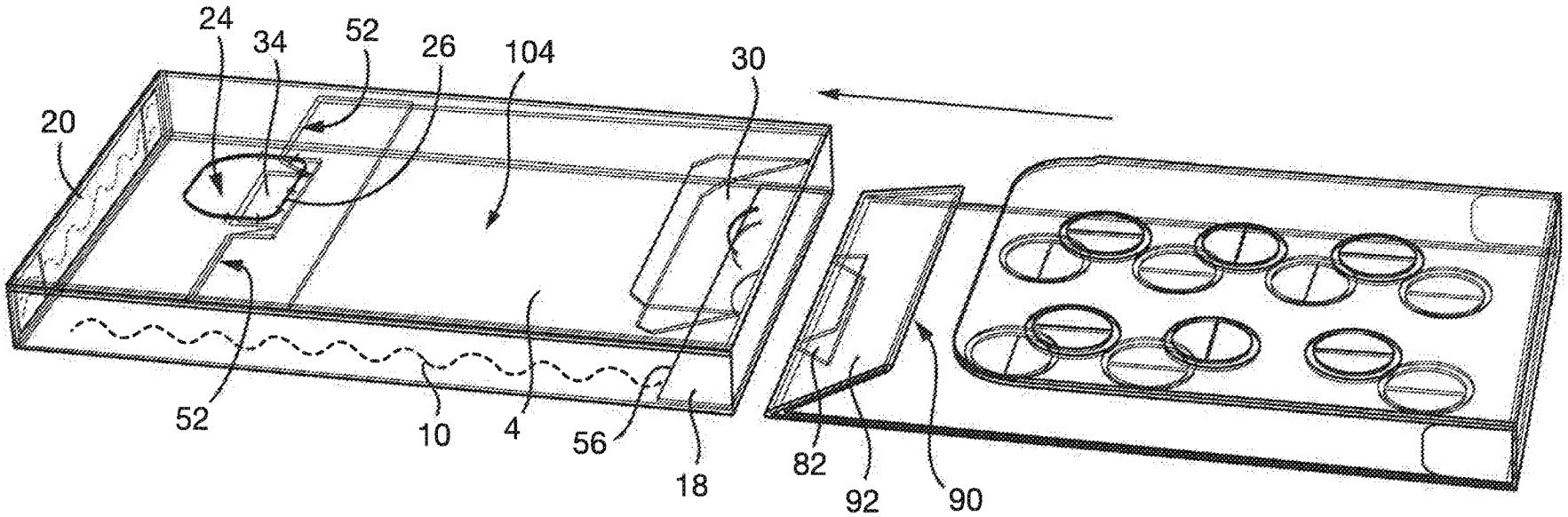
FIG. 12 shows an alternative outer sleeve.

An alternative embodiment is shown schematically in FIG. 12.

In this embodiment, the release button 24 is connected to the sleeve 104 by means of a hinge line 26 which faces towards the open end of the sleeve 104. A tab 34 is defined in the fifth panel 14 of the sleeve 104 and a cut out provided in the distal flap 16 such that when the sleeve blank is erected, the tab 34 lies under the button 24 at its hinge line 26. This provides some additional resilience to the release button 24. Providing the cutout created a pair of locking edges 52 on the sleeve 104. Also, the slider 102 in this embodiment is provided a continuous locking edge 90 as opposed to a pair of locking edges 90*a*, 90*b* as in the earlier embodiment. In this embodiment, if the slider 102 is pushed too far into the sleeve 104 and the button then depressed, the flap 92 may engage over the depressed button 24 and abut the fold line 26 when the slider is withdrawn, preventing movement of the slider 102 past the button.

It will also be recognized that when the slider 102 is in its locked position within the sleeve 104, there may be some degree of overlap between the release button and the slider flap 92. However, that overlap will be at the base end of the release button meaning that there will be insufficient movement generated to release the slider flap 92.

It will be appreciated that other embodiments may be envisaged which function in the same manner as the illustrated embodiment, allowing the package to be opened only when the user slides the slider to an intermediate position between a fully inserted position and a locked position in which the locking edges of the slider and sleeve are engaged. For example, rather than providing a central release button, the release button may be laterally offset towards one side or the other of the sleeve panel 4. The button need not be oriented such that the hinge line defining the button is parallel to the closed end of the sleeve. The locking edge(s) of the sleeve need not extend parallel to the closed end of the sleeve. It will be appreciated that arrangements using a central or offset release button may be selected as desired e.g. depending upon preferences for the resulting package, the needs of a user etc.

What is claimed is:

1. A package comprising:

an outer sleeve having an open end and a closed end;

a slider for holding a blister pack, the slider being slid ably mounted within the outer sleeve;

the outer sleeve comprising a wall having a set of one or more locking edges arranged on the interior of the wall at a spacing from the closed end of the sleeve and facing the closed end of the sleeve;

the slider comprising a locking flap formed at a terminal end of the slider and extending in a direction away from the closed end of the outer sleeve for engagement with the said wall of the outer sleeve, the flap having a free edge which provides a locking edge for engagement with the or each locking edge of said set of one or more locking edges of the outer sleeve wall to thereby prevent the slider from being withdrawn from the outer sleeve in a locked position;

wherein the outer sleeve further comprises a release button, wherein pressing of the release button deflects the slider flap away from said wall of the outer sleeve so as to enable the free edge of the slider flap to slide past the or each locking edge of the set of one or more locking edges of the outer sleeve thereby allowing the slider to be withdrawn from the outer sleeve;

wherein the release button is arranged such that it is operable to deflect the flap in such a manner only when the slider is inserted into the outer sleeve to a position intermediate its locked position and a fully inserted position in which the slider is fully inserted into the outer sleeve.

2. The package of claim 1, wherein the intermediate position is between a closed position in which an end of the slider is aligned with the open end of the sleeve and the fully inserted position.

3. The package of claim 1, wherein the sleeve and/or slider are provided with an indication of the intermediate position.

4. The package of claim 3, wherein the indication comprises a marking on the sleeve against which a marking on the slider or an end wall of the slider should be aligned.

5. The package of claim 4, wherein the outer sleeve further comprises removable tabs at its open end for providing one or more finger notches to provide access to an end of the inserted slider, and wherein the marking is provided adjacent a finger notch.

6. The package of claim 1, wherein, in the fully inserted position, the button if depressed, will not engage with the flap at all, or not engage sufficiently therewith that pressing on the button will deflect the flap substantially.

7. The package of claim 1, wherein the slider locking flap comprises a recess in a distal edge which aligns with a portion of the release button, the release button being capable of entering the recess.

8. The package of claim 1, wherein, when the slider is in the locking position so that the locking edges of the slider and the outer sleeve wall engage, pressing of the release button is not effective to disengage the locking edge of the slider from the or each locking edge of the set of one or more locking edges of the outer sleeve wall to permit further withdrawal of the slider from the outer sleeve.

9. The package of claim 1, wherein the locking edge of the slider flap does not overlap the release button when the slider is in a position relative to the outer sleeve such that the locking edges of the slider and outer sleeve wall are engaged or overlaps a base region of the release button, such that the release button is unable to deflect the flap to an extent necessary to disengage the locking edges.

10. The package of claim 1, wherein the release button is hingedly attached to the outer sleeve wall at the base region through a hinge line.

11. The package of claim 10, wherein the hinge lime is arranged towards the closed end of the sleeve.

12. The package of claim 1, wherein the outer sleeve wall has an outer panel and an inner panel, the set of one or more locking edges of the outer sleeve wall being formed at a terminal end of the inner panel, wherein the inner panel is not secured to the sleeve outer wall adjacent the one or more locking edges, whereby the slider flap is configured to engage under the one or more locking edges.

13. The package of claim 1, wherein the wall of the outer sleeve further comprises a retaining flap formed at the open end of the outer sleeve for engagement with the slider flap to prevent full withdrawal of the slider from the outer sleeve, wherein the retaining flap is formed as a hinged flap released from the inner panel.

14. The package of claim 1, wherein the locking flap is hingedly connected to a panel of the slider about a fold line, and a tongue is connected to the slider panel about the same fold line, the tongue extending away from the outer sleeve wall having the set of one or more locking edges toward an opposite wall of the outer sleeve.

15. The package of claim 14, wherein the tongue is released from a panel of the locking flap.

16. The package of claim 1, wherein the slider comprises a first leaf holding a first blister pack and remote from the wall of the outer sleeve, a second leaf holding a second blister pack and adjacent the wall of the outer sleeve, the first leaf and second leaf joined at an end adjacent the open end of the outer sleeve, the locking flap extending from the first slider leaf towards the outer sleeve wall.

17. The package of claim 1, wherein the release button is arranged such that if the button is pressed with the slider fully inserted in the sleeve, and the slider then withdrawn from the sleeve, the slider flap rides up over the outside of a distal end of the release button.

18. The package of claim 1, wherein the release button extends from a base region attached to the outer sleeve towards the open end or the closed end of the outer sleeve.

19. The package of claim 1, wherein the slider is configured to be withdrawn from the sleeve by a predetermined amount before the free edge of the slider flap engages the or each locking edge of the set of one or more locking edges of the outer sleeve, the predetermined amount being insufficient for a user to access the blister pack.

* * * * *